US005172505A

United States Patent [19]

Borsella

[11] Patent Number: 5,172,505

[45] Date of Patent: Dec. 22, 1992

[54] ADJUSTABLE, PORTABLE, WIND-RESISTANT VEHICULAR SIGN DISPLAY

[76] Inventor: Albert Borsella, 1514 Rockey Point Rd., Middle Island, N.Y. 11953

[21] Appl. No.: 719,982

[22] Filed: Jun. 24, 1991

Related U.S. Application Data

[63] Continuation-in-part of Ser. No. 570,313, Aug. 21, 1990, abandoned.

[51] Int. Cl.[5] ..... G09F 15/00

[52] U.S. Cl. ..... 40/606; 40/604

[58] Field of Search ..... 40/587, 591, 604, 606, 40/612; 116/173; 248/158, 910, 407

[56] References Cited

U.S. PATENT DOCUMENTS

| | | | |
|---|---|---|---|
| 2,167,564 | 7/1939 | Fonda | 40/606 |
| 3,119,588 | 1/1964 | Keats | 40/606 X |
| 3,236,481 | 2/1966 | Howard | 248/158 X |
| 3,262,703 | 7/1966 | Hadlick | 248/158 X |
| 3,559,322 | 2/1971 | Nickel | 40/587 |
| 4,312,452 | 1/1982 | Waier | 248/551 |
| 4,937,962 | 7/1990 | Hornblad | 40/604 X |
| 5,048,779 | 9/1991 | Wurmser | 40/606 X |

FOREIGN PATENT DOCUMENTS

| | | | |
|---|---|---|---|
| 1105660 | 7/1955 | France | 40/591 |

*Primary Examiner*—Kenneth J. Dorner
*Assistant Examiner*—Brian K. Green
*Attorney, Agent, or Firm*—Alfred M. Walker

[57] ABSTRACT

A vehicular display system that has two substantially vertical posts, housing two slidable sections, inserted into bases on either side of a motor vehicle and tilted at an angle for purposes of holding a display banner over said vehicle, and parallel fasteners for adjusting the height of the slidable sections, with a plurality of openings for the attachment by which banner is to be attached to the slidable sections.

3 Claims, 4 Drawing Sheets

ADJUSTABLE, PORTABLE, WIND-RESISTANT VEHICULAR SIGN DISPLAY

This application is a Continuation-In-Part of application Ser. No. 07/570,313, filed Aug. 21, 1990, now abandoned.

BACKGROUND OF THE INVENTION

The present invention relates to an adjustable, portable, wind-resistant vehicular sign display. In particular the present invention relates to improved adjustable posts for displaying sign banners in which the display includes a base used in combination with a parked motor vehicle.

Apparatus used as displays for flexible, outdoor sign banners are known in the art. The use of a trailer base with erect poles is known in the art. However, said systems are cumbersome and difficult to install. Other displays of signs include heavy bases which are awkward and difficult to move. In addition, sign post displays which do not provide a reliable locking system for the posts holding the display banner in place are unreliable, especially in meterological conditions of high winds.

THE PRESENT INVENTION

It is an object of the invention to provide an improved outdoor sign display system in which the system includes an integrated base.

A further object is to provide an improved sign display system in which the system includes a base which is easily adaptable to the tires of a parked motor vehicle so that the weight of the motor vehicle can provide stability for the display system.

A still further object is to provide an improved outdoor sign display system in which the base is provided into the structure of the system without adding unnecessary weight to the system.

More particularly, it is an object of the present invention to provide a base for sign display system in which a base is adaptable to a vehicle tire and then used as a stable base for retractable display posts and virtually without additional weight to the system, and at the same time provide a base that is reliably locked into positions by the tires of the motor vehicle to provide a system with maximum stability and reliability.

It is a further object of the invention to provide a sign display system which permits the taut display of flexible banners which provide flexibility in the event of vigorous outdoor winds.

SUMMARY OF THE INVENTION

The present invention overcomes the disadvantages of the prior art sign display system pointed out above by providing a system with a base adaptable to a motor vehicle. The base is placed beneath a tire of a vehicle when the display system is in an up or display position and the sign banner is supported by the two adjustable two side poles of the system when the system is in the display position.

The system includes two substantially vertical posts. Each post includes two substantially vertical, slidably biased sections in which the smaller section slides up and down within the cylindrical interior of the outer, larger post section connectable to the base adaptable to the vehicle tire.

The substantially verticle posts of each side are connected at the upper end by a horizontal banner sign. The vertical bars are connected at the distal end from the banner by means of the weight of the vehicle tires and provide stability for the base at the bottom end of the substantially vertical posts. Each base contains a plurality of boundary edges, with the edges having a circumferential lip protruding therefrom to define a limiting space for the vehicle tires and to provide barriers to prevent the movement of the tires when the motor vehicle is parked above each of the bases of the sign display system.

The walls of the circumferential lip extend upward from the sides of the base. One wall contains a clamping tube member to house the lower vertical tubular portion of each of the posts. The clamping tube member extends upward at the slight angle off a vertical access to accommodate the lowermost of the substantially vertical posts.

The substantially vertical posts of the sign display system are deviated outwardly at a slight acute angle off a vertical axis rising vertically from the horizontal base. The outward deviation of the posts off of the vertical axis prevents the posts from collapsing inward toward each other under high winds and adverse meteorological conditions, which may cause the flexible sign banners to billow, thereby threatening stability by pulling upright posts towards each other.

The Applicant's invention is important because it provides a vehicular display system for flexible banners including a means for preventing the inward collapsing of the posts holding the banners when the posts are subject to adverse winds and meteorological conditions. Under such adverse conditions, the flexible banner will tend to "billow" causing the vertical posts to slightly collapse inward and thereby scratch the vehicle by which the posts are held or perhaps the complete collapse and breakage of the posts. Therefore, the Applicant's device deviates the posts at a slight acute angle outwardly off of the vertical axis arising from the vertical base. The posts are pre-stressed to "give" under pressure to return to this slightly deviated angle after the posts have been forced inward by the mechanical application of wind driven force upon the billowing of the flexible banner sign display.

Furthermore, the position of the posts enables a flexible sign banner to remain taut while in the displayed position.

The vertical adjustability of trombone effect of the upper vertical post within the hollow lower vertical post permits adjusting the height of the sign banner, preferably rectangular in form.

The invention itself will be best understood when a preferred embodiment of the invention is described with reference to the accompanying drawings.

DESCRIPTION OF THE INVENTION

Figure 1:
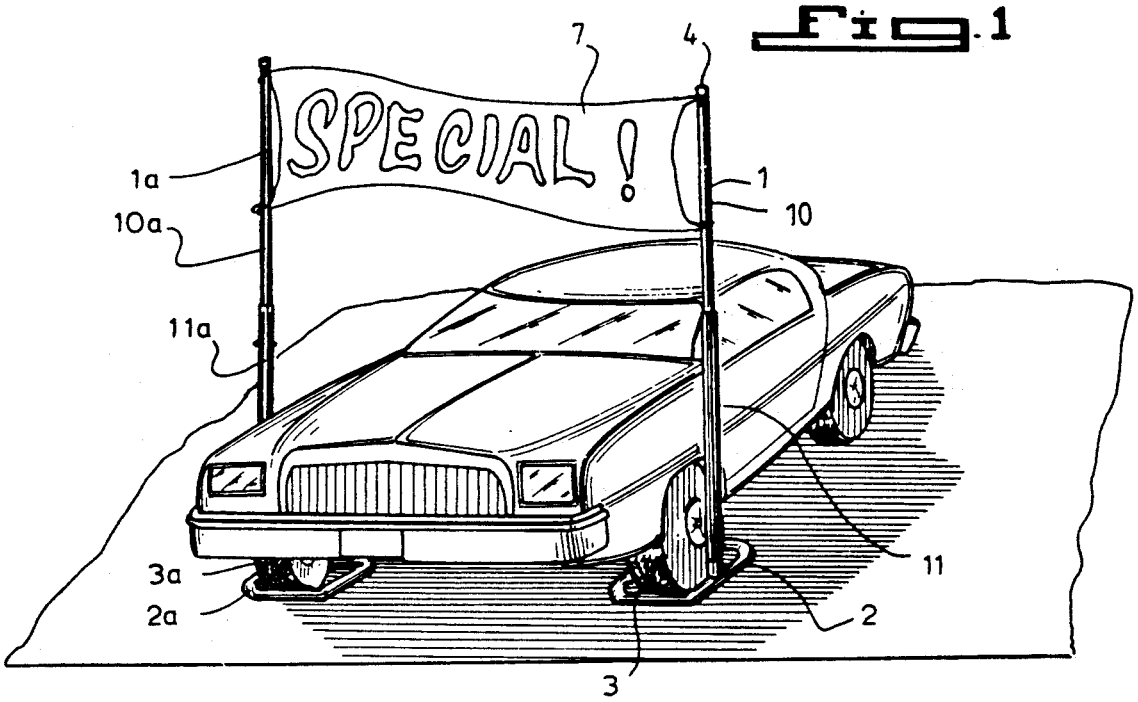
FIG. 1 is a perspective view of the sign display system in accordance with the teachings of the present invention, with the display system in the display position.
Figure 2:
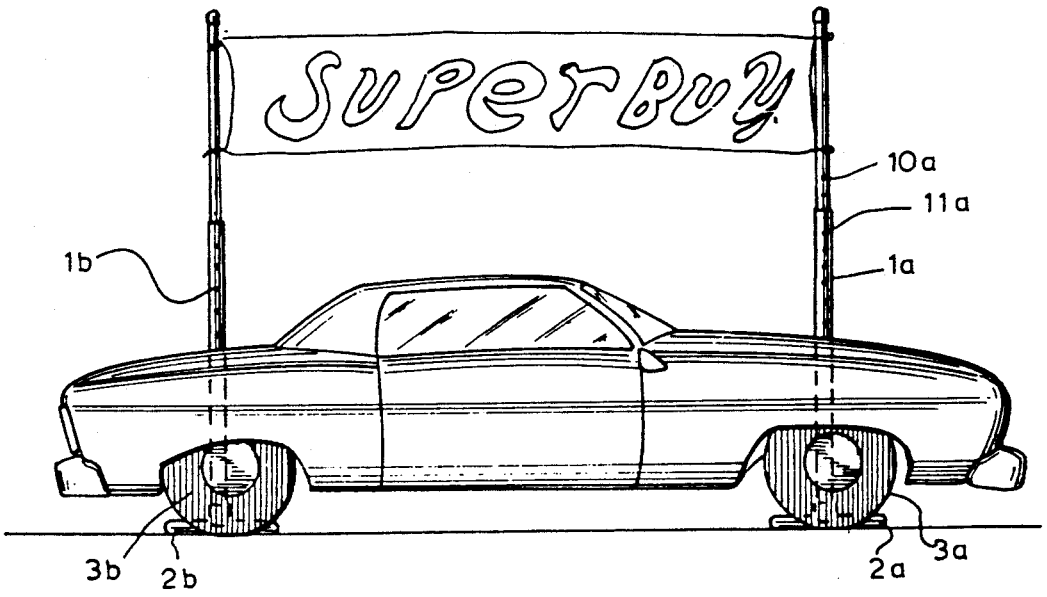
FIG. 2 is an alternate perspective view of the display system in accordance with the teachings of the present invention, with the display system in the display position.

Attention is directed to FIGS. 1 and 2, each of which shows a preferred embodiment of the invention from a different angle and in a different condition, respectively. The present invention is an adjustable, portable, wind-resistant vehicular sign display system. Instruments of this kind are generally referred to as "sign display systems".

The system generally includes two substantially vertical posts. Each post includes two substantially vertical, slidably biased sections in which the smaller section slides up and down within the cylindrical interior of the outer, larger post section connectable to the base adaptable to the vehicle tire, providing for stability under inclement meteorological conditions.

The preferred structure of the present invention provides a vehicular sign display system as shown in FIG. 1.

Referring to FIG. 1, the vehicular sign display system contains two substantially tubular lower post sections 11 and 11*a*, which house substantially vertical slidably upper post sections 10 and 10*a*, respectively, when the system is not in use. Substantially biased posts 11 and 11*a* are placed in base housings 2 and 2*a*, respectively, which are adjustable to the size of the motor vehicle tires 3*a* and 3*b*.

Substantially vertical, slidably biased sections 10 and 10*a* are positioned at a height desired by the user, secured within the posts 11 and 11*a* at that height by fastener 14.

Figures 3, 3A, 4:
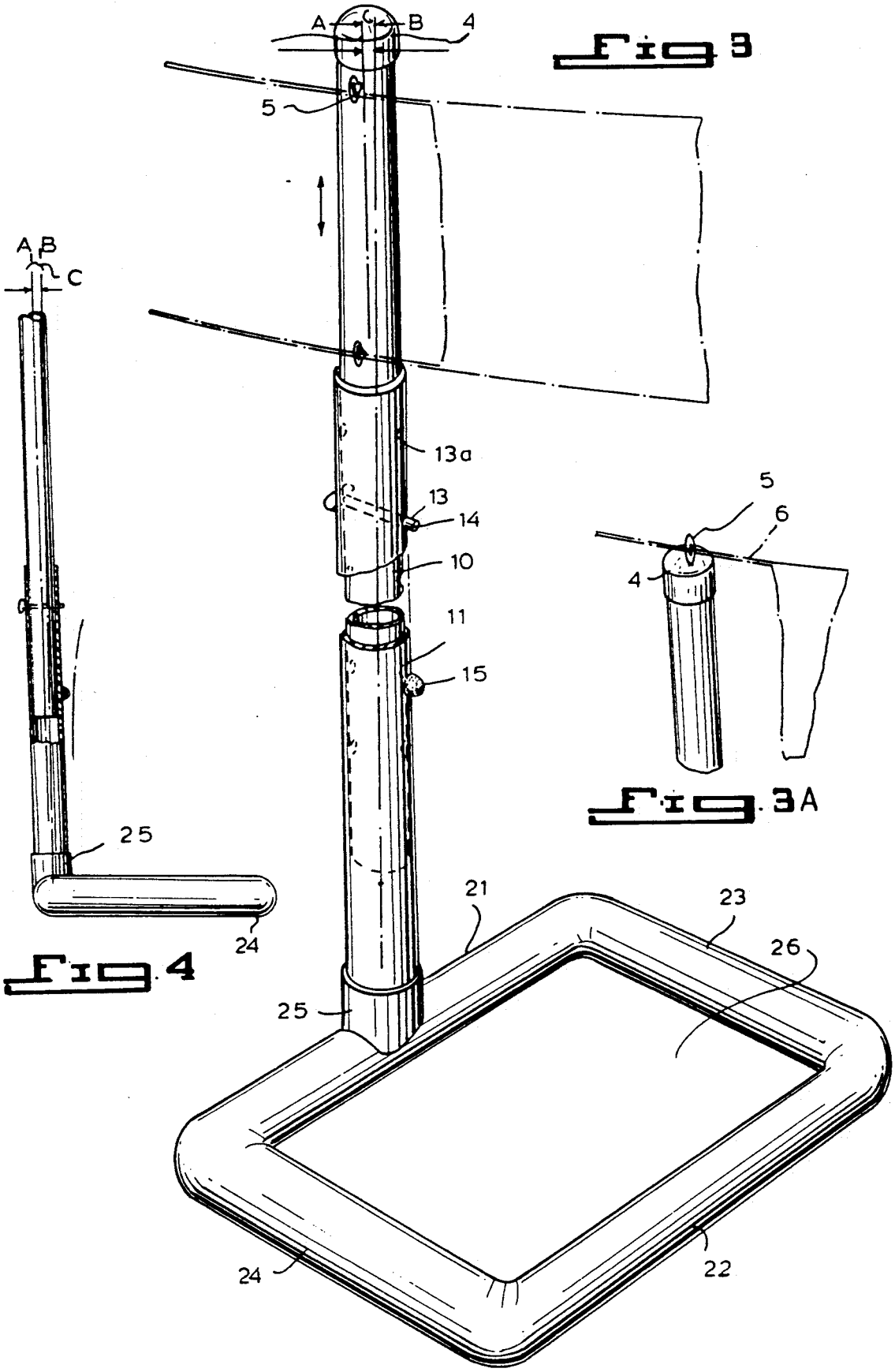
FIG. 3 is a detailed view of one of the two substantially vertical posts mounted to the base, showing how the post extends from the base and receives a banner for display.
FIG. 3*a* is a view of the top of one of the two substantially vertical posts, showing the attachment of the top of the display banner.
FIG. 4 is a sectional view of one of the two substantially vertical posts as it is connected to the base of the system.
Figure 5:
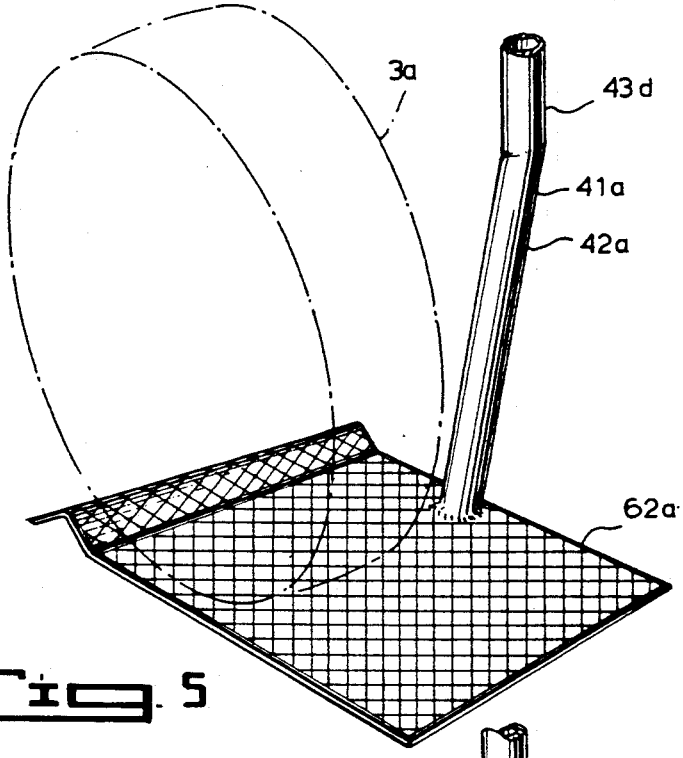
FIG. 5 is a perspective view of another embodiment of the sign display system in accordance with the teachings of the present invention, with the display system in the display position.
Figure 6:
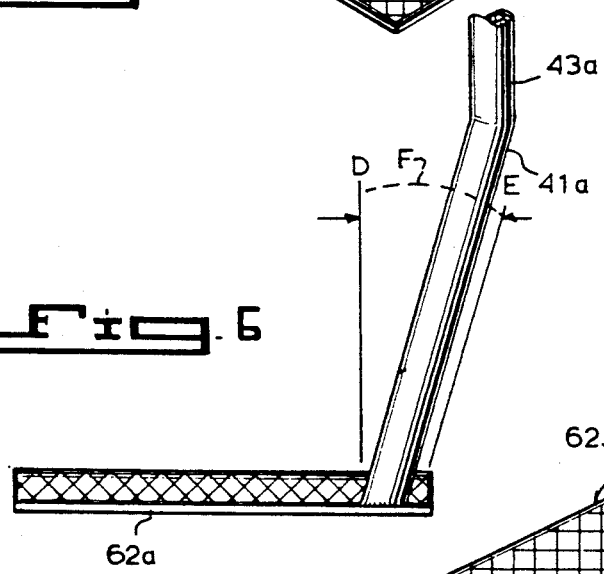
FIG. 6 is a detailed rear elevation view of the embodiment of the invention as shown in FIG. 5.
Figure 7:
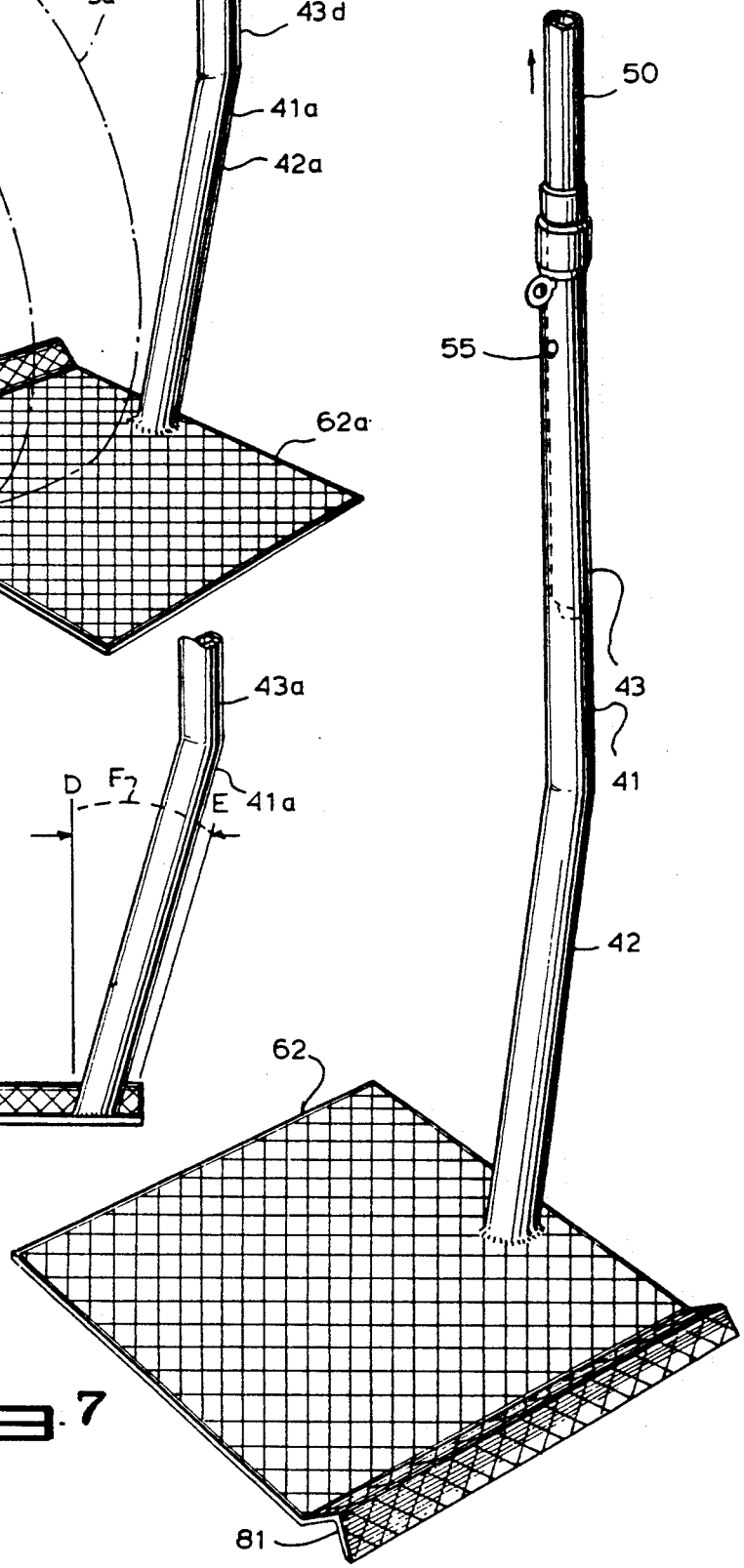
FIG. 7 is an alternate perspective view of the display system as shown in FIG. 5 with the display system in the display position.
Figure 8:
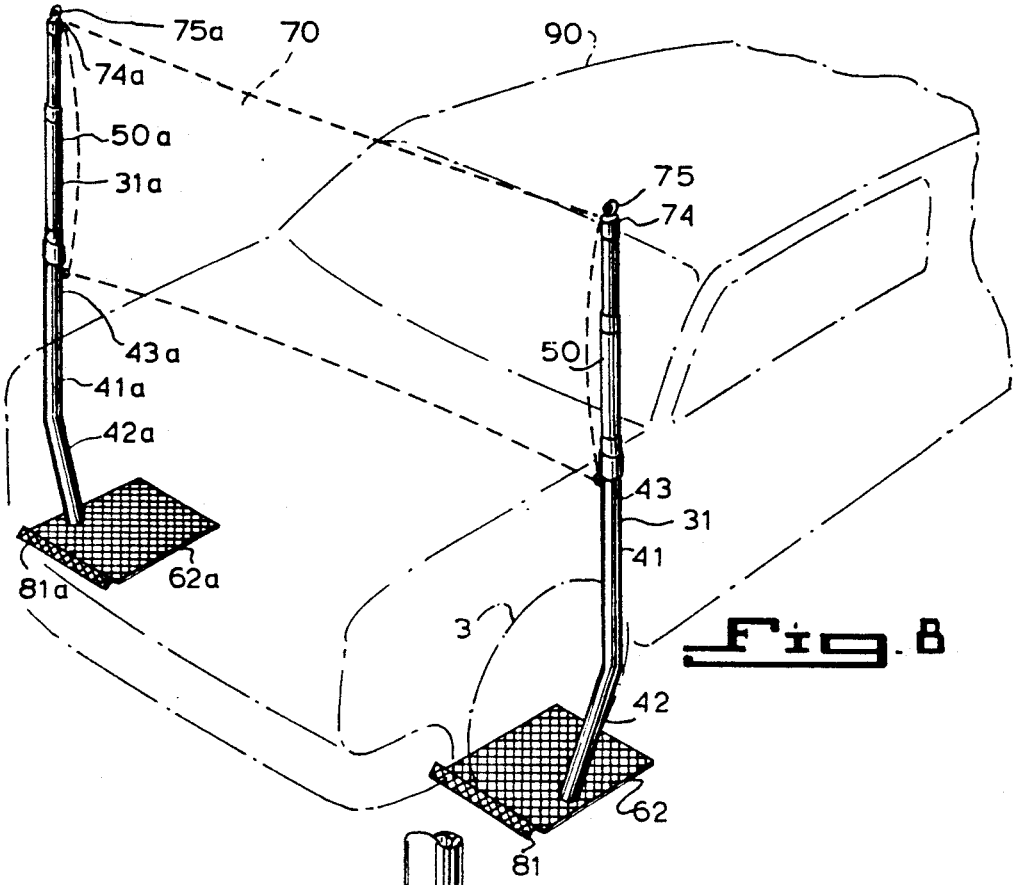
FIG. 8 is an alternate perspective view of the two substantially vertical posts mounted to the base, of the embodiment of the invention as shown in FIG. 5.
Figure 9:
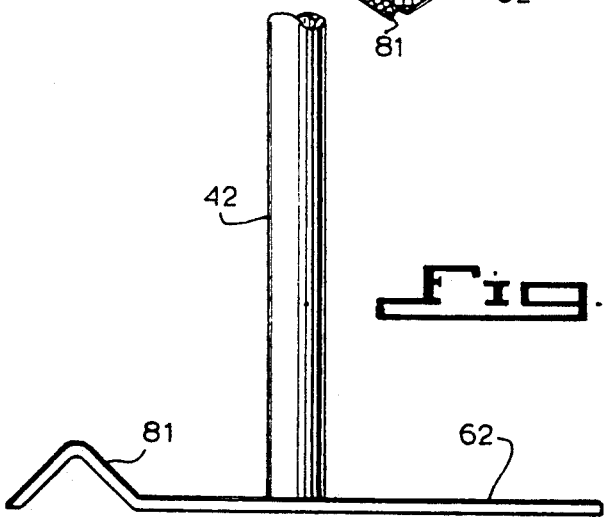
FIG. 9 is a detailed side elevational view of part of one of the two substantially vertical posts, of the embodiment as shown in FIG. 5.
Figure 10:
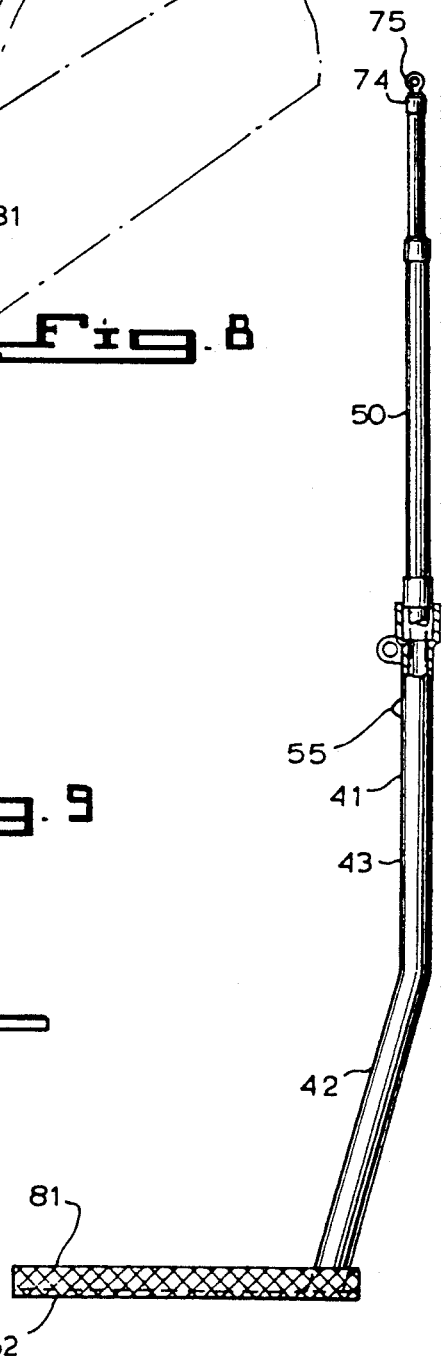
FIG. 10 is a front elevational view of one of the two substantially vertical posts as it is connected to the base of the system, in the embodiment as shown in FIG. 5.

A principal feature of this invention is the ability of the substantially vertical posts 11 and 11*a* to maintain stability even under inclement meteorological conditions. FIGS. 3 and 4 show how this is accomplished.

Substantially vertical posts 1 and 1*a* are tilted at a biased angle C away from motor vehicle 3 by a distance AB, as shown in FIG. 4. The tilting of the posts allows for an inward "give" of the posts while under stress from sign banners billowing in the wind. Pliable rubber bumpers 15, 15*a*, 15*b* and 15*c* are placed upon lower post section 15 to prevent scratching or denting damage to the fender of the car adjacent to posts 1 and 1*a*.

Display banner 7 is affixed to posts 1 and 1*a* by the use of material which is placed through eyelet openings 5 and 5*a* at the distal end caps 4 and 4*a* of posts 1 and 1*a*.

The weight of tires 3 and 3*a* keep substantially vertical posts 1 and 1*a*, with extended sections 10, 11, 10*a* and 11*a* respectively in place.

Another embodiment of the invention is shown in FIG. 2, wherein bases 2*a* and 2*b* are positioned on the right front and right rear tires 3*a* and 3*b*, respectively. Substantially vertical posts 1*a* and 1*b* are secured by the weight of tires 3*a* and 3*b* resting upon bases 2*a* and 2*b*, respectively. In FIG. 2, substantially vertical, slidably biased upper post sections 10*a* and 10*b* extend from lower post sections 11*a* and 11*b* in the same manner as sections 10 and 10*a* do above from 11 and 11*a* in FIG. 1.

The base 2 of the display system contains a plurality of upward tubular lip edges 21, 22, 23 and 24, capable of forming a circumferential lip protruding above base floor portion 26 to define a limiting space for vehicle tires 3*a* and 3*b* and to provide barriers to prevent the movement of the tires when motor vehicle 3 is parked above each of the bases of the sign display system.

Substantially vertical lower post section 11 slidingly fits into housing member 25 at a mid point on edge 21 in base 2. Slidable upper post section 10 slides up from lower post section 11 and is secured in one of openings 13, 13*a*, etc. by fastener 14. Slidable lower post section 11 is capped at its distal end by a cap 4.

An alternate version of attaching display banner 7 to slidable section 11 is shown in FIG. 3*a*. Eyelet 5 is placed atop cap 4 through which banner attaching rope 6 may pass.

In another embodiment as shown in FIGS. 5 through 10, the post itself may be completely vertical, but the same effect of providing an angle for the posts is provided by first diverting the lower portion of each lower section of each post at a lower oblique angle outward and then the vertical rising of the upper portion of the lower section of the posts. The shape of the posts creates a spring-like resistance to any wind driven force which may billow the flexible sign display and cause the post to slightly collapse inward. Each post has a plurality of sections, the lower portion of the lower section being obliquely angled and the top portion being extended vertically upward.

Attention is directed to FIGS. 5 through 10, each of which shows another embodiment of the invention. This additional embodiment also is an adjustable, portable, wind-resistant vehicular sign display system.

This embodiment generally includes two substantially vertical posts in two sections. The first, outer base section rises at a slight angle off of the base, and then rises vertically to the point where an upper, inner section is inserted therein. The outer, larger post section is connectable to the base adaptable to the vehicle tire, providing for stability under inclement meteorological conditions.

Referring to FIGS. 5 through 10, the vehicular sign display system contains two posts 31 and 31*a* substantially tubular lower post sections 41 and 41*a*, having lower portions 42 and 42*a* and upper portions 43 and 43*a*, which house substantially vertical slidably upper post sections 50 and 50*a*, respectively, when the system is not in use. Substantially biased posts 41 and 41*a* are placed in base housings 62 and 62*a*, respectively, which are adjustable to the size of motor vehicle tires 3*a* and 3*b*.

Substantially vertical, slidably biased sections 50 and 50*a* are positioned at a height desired by the user, secured within post sections 43 and 43*a* at that height by fastener 54.

A principal feature of this invention is the ability of the substantially vertical posts 41 and 41*a* to maintain stability even under inclement meteorological conditions.

The lower portions 42 and 42*a* of lower sections 41 and 41*a* substantially vertical posts 31 and 31*a* are tilted at a biased angle away from motor vehicle 90. The tilting of the posts allows for an inward "give" of the posts while under stress from sign banners billowing in the wind. Pliable rubber bumpers 55, and 55*a* are placed upon the upper sections 43 and 43*a* of lower post sections 41 and 41*a* to prevent scratching or denting damage to the fender of the car.

Display banner 70 is affixed to upper sections 50 and 50*a* posts 31 and 31*a* by the use of material which is placed through eyelet openings 75 and 75*a* at the distal end caps 74 and 74*a* of posts 41 and 41*a*.

The weight of tires 90*a* and 90*b* of vehicle 90 keep substantially vertical posts 31 and 31*a*, with extended sections 50, 41, 50*a* and 41*a* respectively in place.

The bases 62 and 62*a* of the display system contains at least one of upward tubular lip edges 81 and 81*a*, capable of forming a limiting lip protruding above base floor portions 86 and 86*a* to define a limiting space for vehicle tires 90*a* and 90*b* and to provide barriers to prevent movement of the tires when motor vehicle 90 is parked above each of the bases of the sign display system.

I claim:

1. An adjustable, portable, wind resistant vehicular flexible sign display system for an automobile motor vehicle with tires comprising:

a) a first base having at least one edge lip protruding upward from said base, said base adapted to receive one of said vehicle's tires rolled thereon;

b) a first post extending up from said base, said first post including a lower section and an upper section, said upper section of said first post slidably and adjustably secured within said lower section of said first post;

c) a second base having at least one edge lip protruding upward from said second base, said base adapted to receive one of said vehicle's tires rolled thereon;

d) A second post extending up from said second base, said second post including a lower section and an upper section, said upper section of said second post slidably and adjustably secured within said lower section of said second post;

e) A display sign having a top edge, a bottom edge, a first side end edge and a second side end edge; and f) said display sign attached at said first side end edge to said first post and said display sign attached at said second side end edge to said second post;

g) said lower section of said first post extends generally vertically upwardly and outwardly from said first base at a slight oblique angle and said upper section of said first post extends generally vertically upwardly and outwardly from said lower section of said first post;

h) said lower section of said second post extends generally vertically upwardly and outwardly upward from said second base at a slight oblique angle and said upper section of said second post extends generally vertically upwardly and outwardly from said lower section of said second post.

2. A vehicular display system as in claim 1 and in which each of said vertical posts may be adjusted according to the need of the user by the use of fasteners through holes in said posts.

3. A vehicular display system as in claim 1 including a multiplicity of attaching means to attach said display sign to said posts.

* * * * *